US007114489B2

(12) United States Patent
Wenke et al.

(10) Patent No.: US 7,114,489 B2
(45) Date of Patent: Oct. 3, 2006

(54) FUEL-INJECTOR MANIFOLD ASSEMBLY

(75) Inventors: Volker Wenke, Detmold (DE); Lars Sonntag, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 265 days.

(21) Appl. No.: 10/890,551

(22) Filed: Jul. 13, 2004

(65) Prior Publication Data

US 2005/0035595 A1 Feb. 17, 2005

(30) Foreign Application Priority Data

Jul. 23, 2003 (DE) ..... 103 33 721

(51) Int. Cl.
*F02M 55/02* (2006.01)

(52) U.S. Cl. ..... 123/456; 123/468

(58) Field of Classification Search ..... 123/456, 123/468, 469

See application file for complete search history.

(56) References Cited

U.S. PATENT DOCUMENTS

| | | | | |
|---|---|---|---|---|
| 4,971,014 | A * | 11/1990 | Usui | 123/470 |
| 6,374,809 | B1 | 4/2002 | Satou | |
| 6,418,911 | B1 | 7/2002 | Augustin | |
| 2003/0019477 | A1 | 1/2003 | Bodenhausen et al. | |
| 2003/0056760 | A1* | 3/2003 | Knoedl et al. | 123/456 |
| 2004/0003795 | A1* | 1/2004 | Kondo | 123/447 |
| 2005/0005910 | A1* | 1/2005 | Usui et al. | 123/456 |
| 2005/0166898 | A1* | 8/2005 | Braeuer et al. | 123/456 |

FOREIGN PATENT DOCUMENTS

| | | |
|---|---|---|
| DE | 197 44 762 | 1/1998 |
| DE | 100 20 506 | 10/2001 |
| DE | 101 36 050 | 2/2003 |
| GB | 2 324 337 | 10/1998 |

OTHER PUBLICATIONS

Japanese Patent Office; Publication No. 2003120470 A; Appl. No. 2001312759; Applicant: Toyota Motor Corp.

* cited by examiner

*Primary Examiner*—Thomas Moulis
(74) *Attorney, Agent, or Firm*—Andrew Wilford

(57) ABSTRACT

A fuel-supply manifold assembly has a thin-wall tube extending along a tube axis and formed with a plurality of radially throughgoing ports and respective saddle fittings each formed with a face complementary to and fitting with an outer surface of the tube at a respective one of the ports and with a throughgoing passage having an inner end aligned with the respective port. Respective tubular alignment nipples each have a throughgoing passage and each further have an inner end seated in a respective one of the ports and an outer end seated in the inner end of the respective fitting.

5 Claims, 4 Drawing Sheets

FUEL-INJECTOR MANIFOLD ASSEMBLY

FIELD OF THE INVENTION

The present invention relates to fuel-injection system. More particularly this invention concerns a fitting for connecting a fuel injector to a fuel-supply manifold.

BACKGROUND OF THE INVENTION

Figure 1:
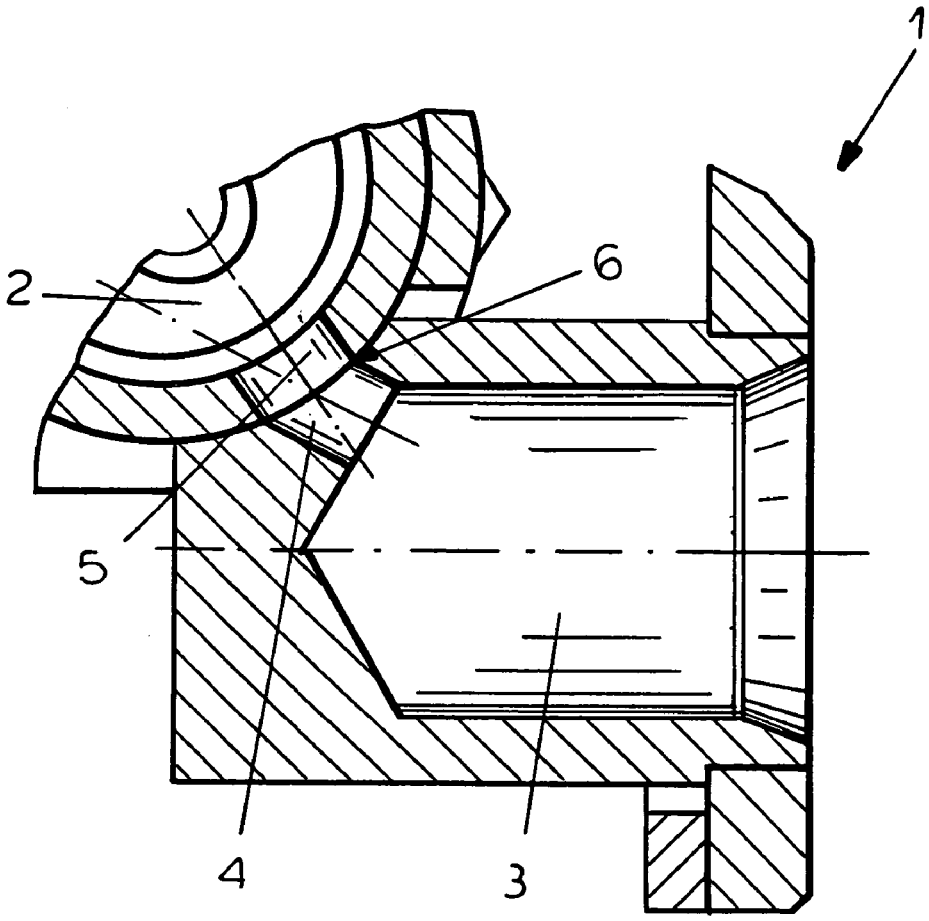
FIG.1 PRIOR ART
FIG. 1 is a section through a prior-art fuel-injection tube and fitting.

A prior-art gasoline engine internal-combustion has as shown in FIG. 1 a manifold tube 2 that connects the high-pressure fuel pump to the fuel injectors of the engine's cylinders. This manifold tube 2 is pressurized normally at about 200 bar and the pressure in it can peak at 450 bar, reaching a staggering 1600 bar for some diesel systems. The tube 2 is typically made of stainless steel so that it can resist both this enormous pressure and the chemical attack of the fuel. As a result of the cost of the steel, its weight, and the difficulty working it, it is invariably made of relatively thin stock so that it is impossible, for instance, to thread ports 5 in it from which the fuel exits to the injectors.

Hence the tube 2 is provided as described in German 100 20 605 and 197 44 762 with saddle fittings 3 that are secured to the outside surface of the tube 2 at the ports 5. Each fitting 3 is formed with a throughgoing passage 4 of a flow cross section that is normally somewhat greater than that of the respective port 5, both normally being circular in section, so that if the passage 4 does not extend perfectly radially of the tube 2 or is not perfectly centered on the respective port 5 the fuel can still pass.

Making up such a manifold assembly 1 is fairly difficult. Once the manifold tube 2 is drilled to have the necessary ports 5, the saddle fittings 3 must be positioned to align their passages 4 perfectly with the respective ports 5, then they are soldered or welded in place at the joint 6. Unfortunately, each saddle fitting 3 covers its port 5 and, since the passage 4 in the fitting 3 is often oriented nonradially of the tube 2, it is impossible to verify the position. Inserting an alignment pin through the fitting passage 4 into the port 5 to ensure proper alignment is moderately effective although difficult to do in a mass-production operation. Typically the fitting 3 is spot-welded to the tube 2 when aligned with a pin, then the entire manifold assembly 1 is welded in one operation, in which case the previously made spot weld blocks the ability of the solder wash to enter the joints 6 between the fittings 3 and the tube 2.

Any misalignment, even a very minor one, creates a restriction that produces turbulence in the passing fluid. When the fitting passage 4 is of greater diameter than the port 5, which is common, the port edges create turbulence even with perfect alignment. What is more, the solder holding the fitting 3 to the tube 2 is exposed to the fuel passing through the assembly and can be attacked by it, weakening the joint and possibly creating a dangerous leak.

OBJECTS OF THE INVENTION

It is therefore an object of the present invention to provide an improved manifold assembly.

Another object is the provision of such an improved manifold assembly which overcomes the above-given disadvantages, that is which is particularly easy to assemble and that allows a perfectly soldered and aligned joint to be made at each saddle fitting.

SUMMARY OF THE INVENTION

A fuel-supply manifold assembly has according to the invention a thin-wall tube extending along a tube axis and formed with a plurality of radially throughgoing ports and respective saddle fittings each formed with a face complementary to and fitting with an outer surface of the tube at a respective one of the ports and with a throughgoing passage having an inner end aligned with the respective port. Respective tubular alignment nipples each have a throughgoing passage and each further have an inner end seated in a respective one of the ports and an outer end seated in the inner end of the respective fitting.

Such a nipple ensures perfect alignment of the fitting with the respective tube port. The inner end of the passage of the fitting is enlarged to be the same as the outer diameter of the nipple whose inner diameter can be equal to or smaller than the inner diameter of the rest of the fitting passage. This completely eliminates the possibility of turbulence at the port edge, since this edge is actually covered up by the alignment nipple. The nipple is a snug fit in both the tube port and the fitting passage, so that during manufacture of such a manifold assembly one can completely dispense with the hitherto used spot weld. In other words, the nipples are fitted to the respective passages and then the fittings are fitted to the respective ports, or the nipples are fitted to the ports and the fittings are fitted to the nipples, whereupon the entire assembly can be soldered together in a single operation. The alignment nipple will normally prevent direct contact between the fuel and the solder which is important since the solder is invariably less resistant to chemical attack than the metals of the tube and fitting.

According to the invention each fitting is formed at the respective inner end with a radially inwardly open groove holding a solder ring. Thus after the assembly is put together, it need merely be heated to form the necessary solder joints. This makes for a very neat joint, as the ring will ensure that the weld is perfectly annular around the joint between the fitting and the tube, and will eliminate having to get solder into the joint from outside.

The nipple passage can be according to the invention of smaller flow cross section than the fitting passage. Thus it acts as a calibrated restriction. Thus with the same manifold tube and fittings, it is possible to use different nipples to meter the fuel flow for different applications.

It is also possible with the instant invention to unitarily form the nipple with the fitting. In this case it is actually an annular ridge on the face of the fitting that fits in the port of the manifold tube.

SPECIFIC DESCRIPTION

Figure 2:
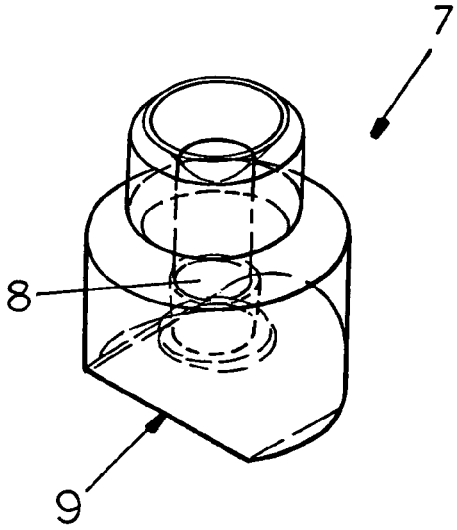
FIG. 2 is a perspective view of a fuel-injection fitting according to the invention.
Figure 3:
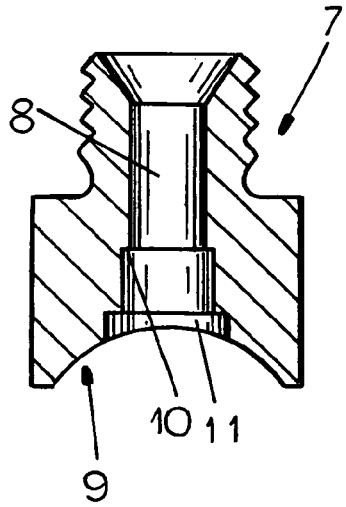
FIG. 3 is an axial section through the fitting of FIG. 2.

As seen in FIGS. 2 and 3 a saddle fitting 7 according to the invention has a part-cylindrical face 9 of a radius of curvature equal to that of the outside surface of the tube 2 and a throughgoing cylindrical passage 8 having an inner portion 10 of enlarged diameter. An extreme inner end of the inner portion 10 is formed with a larger-diameter groove or setback 11 adapted to receive a solder ring described below. An outer end of the fitting is externally threaded for easy connection of a fuel line leading to an injector.

Figure 4:
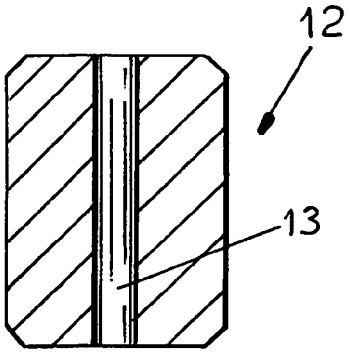
FIGS. 4 and 5 are larger-scale axial sections through two different alignment/liner nipples according to the invention.

FIGS. 3 and 4 show two alignment/liner nipples 12 and 12' having outside diameters identical to the inside diameter of the enlarged portion 10. The nipple 12 has a passage 13 of substantially smaller diameter than that of the passage 8 while the nipple 12' has a passage 14 of substantially larger diameter. A comparison of FIGS. 3 and 4 makes it clear that, simply by selection of which nipple, one can control the flow cross section for different applications.

Figure 5:
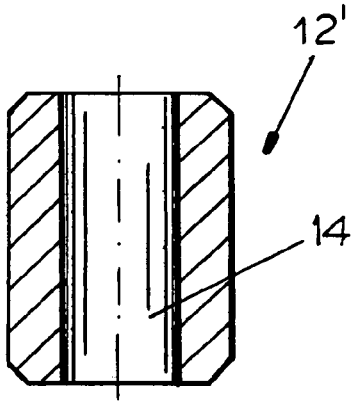
Figure 6:
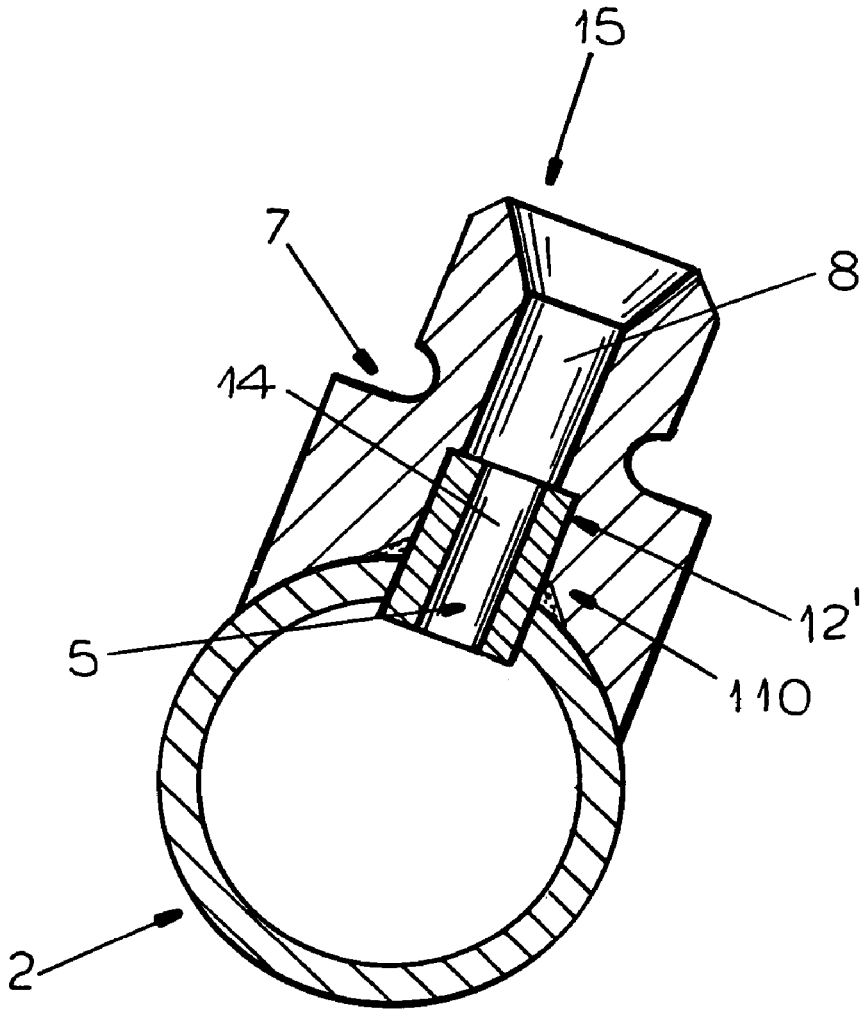
FIG. 6 is an axial section through a manifold assembly formed of the tube of FIG. 1, the fitting of FIGS. 2 and 3, the nipple of FIG. 5.

FIG. 6 shows an assembly 15 comprised of the tube 2 of FIG. 1, the fitting 7 of FIGS. 2 and 3, the nipple 12' of FIG. 5, and a solder ring 110 set in the widened inner-end region 11. Application of heat to this assembly 15 will melt the ring 110 to form a neat annular solder joint between the tube 2, fitting 7, and nipple 12', the solder being wholly contained in the joint.

Figure 7:
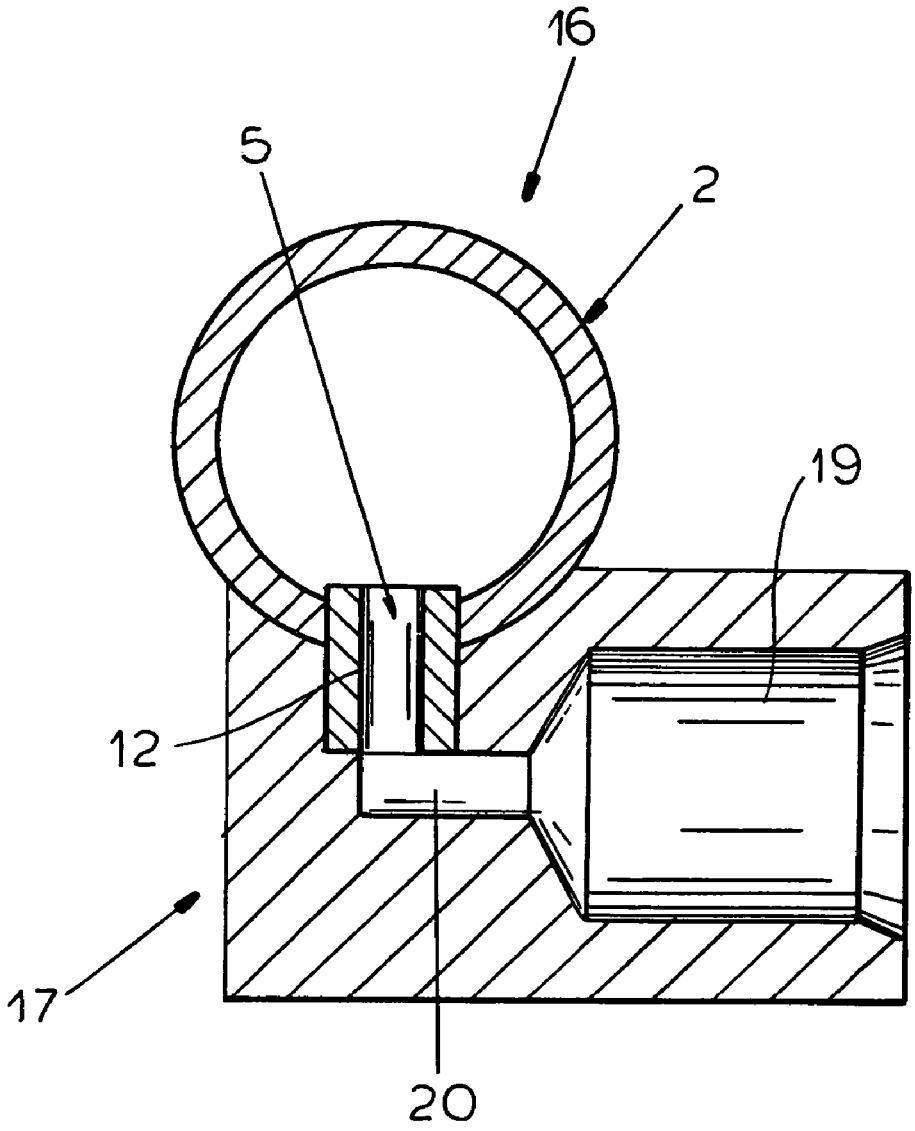
FIG. 7 is a section through another assembly in accordance with the invention.

In FIG. 7 an assembly 16 is shown having the tube 2, but a fitting 17 with a passage 20 extending at a right angle to the nipple 12 of FIG. 4. An outer end region 19 of the passage 20 is enlarged to receive a fuel injector or the like. The inside diameter of the nipple 12 is substantially equal to that of the passage 20.

We claim:

1. A fuel-supply manifold assembly comprising:

a thin-wall tube extending along a tube axis and formed with a plurality of radially throughgoing ports;

respective saddle fittings each formed with a face complementary to and fitting with an outer surface of the tube at a respective one of the ports and with a throughgoing passage having an inner end aligned with the respective port; and respective tubular alignment nipples each having a throughgoing passage and each having an inner end seated in a respective one of the ports and an outer end seated in the inner end of the respective fitting.

2. The fuel-supply manifold assembly defined in claim 1 wherein each fitting is formed at the respective inner end with a radially inwardly open groove, the assembly further comprising a solder ring set in the groove.

3. The fuel-supply manifold assembly defined in claim 1, further comprising solder securing the faces of the fittings to the outer surface of the tube.

4. The fuel-supply manifold assembly defined in claim 1 wherein the nipple passage is of smaller flow cross section than the fitting passage.

5. The fuel-supply manifold assembly defined in claim 1 wherein a saddle fitting is unitarily formed with the fitting.

* * * * *